US009781998B2

(12) United States Patent
Mogensen et al.

(10) Patent No.: US 9,781,998 B2
(45) Date of Patent: Oct. 10, 2017

(54) SYSTEM FOR THE MOUNTING OF SHELVES

(71) Applicant: LCC 2015 ApS, Odense N (DK)

(72) Inventors: Erling Kristen Mogensen, Middelfart (DK); Søren Bøgede Andersen, Odense (DK); Steen Juul Thomsen, Morud (DK)

(73) Assignee: LCC 2015 ApS, Odense N (DK)

( * ) Notice: Subject to any disclaimer, the term of this patent is extended or adjusted under 35 U.S.C. 154(b) by 0 days.

(21) Appl. No.: 14/912,664

(22) PCT Filed: Aug. 20, 2014

(86) PCT No.: PCT/DK2014/050246
§ 371 (c)(1),
(2) Date: Feb. 18, 2016

(87) PCT Pub. No.: WO2015/024571
PCT Pub. Date: Feb. 26, 2015

(65) Prior Publication Data

US 2016/0198848 A1 Jul. 14, 2016

(30) Foreign Application Priority Data

Aug. 21, 2013 (DK) ..... 2013 70455

(51) Int. Cl.
*A47B 43/00* (2006.01)
*A47B 57/50* (2006.01)
(Continued)

(52) U.S. Cl.
CPC ..... *A47B 57/50* (2013.01); *A47B 47/0083* (2013.01); *A47B 57/402* (2013.01);
(Continued)

(58) Field of Classification Search
CPC ... A47B 57/50; A47B 57/402; A47B 47/0083; A47B 96/068; A47B 96/14; A47B 96/1475; A47B 2031/005; A47B 57/06
(Continued)

(56) References Cited

U.S. PATENT DOCUMENTS 395,328 A * 1/1889 Jewell ..... A47B 57/16 108/110
407,882 A * 7/1889 Wilder ..... A47J 37/0704 126/214 R
(Continued)

FOREIGN PATENT DOCUMENTS

CN 2439812 Y 7/2001
CN 1977737 A 6/2007
(Continued)

OTHER PUBLICATIONS

Danish Search Report issued in related application No. PA 2013 70456, Apr. 4, 2014.
(Continued)

*Primary Examiner* — Joshua J Michener
*Assistant Examiner* — Devin Barnett
(74) *Attorney, Agent, or Firm* — Day Pitney LLP

(57) ABSTRACT

The invention relates to system for the mounting of shelves on a substantially rectangular load carrier having four identical columns arranged in the corners thereof. The system comprises columns having a rectangular profile with four side faces, a substantially rectangular shelf of a length which is shorter than the distance between the columns of the load carrier, on which shelf a holder is mounted that can be inserted into complementary slots in the columns of the load carrier, said slots being configured with a support face with which the holder is capable of engaging in such a manner that the holder supports on the column. The columns as such
(Continued)

are configured with slots that extend symmetrically about a longitudinally extending center axis of one of the side faces and through the side faces adjacent to that side face. The slots are each separately configured with three substantially identical cut-outs, the one of which is situated in the axis of symmetry and the two remaining ones are in the adjacent side faces. The cut-outs are function as support faces for the holders of the shelf, them being arranged on the shorter sides of the shelf and extending in the longitudinal direction of the shelf to the effect that they are capable of engaging with the slots in the four columns arranged on the load carrier.

11 Claims, 4 Drawing Sheets

(51) Int. Cl.

| | |
|---|---|
| ***A47B 57/40*** | (2006.01) |
| ***A47B 47/00*** | (2006.01) |
| ***A47B 96/06*** | (2006.01) |
| ***A47B 96/14*** | (2006.01) |
| *A47B 57/06* | (2006.01) |
| *A47B 31/00* | (2006.01) |

(52) U.S. Cl.
CPC ..... *A47B 96/068* (2013.01); *A47B 96/14* (2013.01); *A47B 96/1475* (2013.01); *A47B 57/06* (2013.01); *A47B 2031/005* (2013.01)

(58) Field of Classification Search
USPC ..... 211/186, 187, 134, 135; 108/106, 107, 108/109, 110, 147.11, 147.12, 147.15
See application file for complete search history.

(56) References Cited

U.S. PATENT DOCUMENTS 506,829 A * 10/1893 Ohmer ..... A47B 57/16 108/110
722,760 A * 3/1903 Scarborough ..... A47B 57/16 108/109
966,002 A * 8/1910 Fricke ..... A47B 57/265 108/107
1,829,009 A 10/1931 Madsen
1,976,810 A * 10/1934 Skar ..... A47B 57/08 108/110
2,528,807 A * 11/1950 Whitney ..... A47B 57/16 108/110
2,549,879 A * 4/1951 Amore ..... F25D 25/02 211/134
2,915,196 A 12/1959 Pira
2,933,193 A * 4/1960 De Mattia ..... A47B 57/10 108/156
2,966,967 A 1/1961 Levy et al.
3,007,708 A 11/1961 Ochs
3,265,018 A 8/1966 Joyce
3,269,338 A * 8/1966 Shewell ..... A47B 47/024 108/109
3,281,104 A * 10/1966 Hamilton ..... F16B 12/50 108/106
3,295,695 A 1/1967 Carmstrom
3,322,077 A 5/1967 Kovacik
3,422,775 A * 1/1969 Johnsson ..... A47B 57/16 108/109
3,435,958 A 4/1969 Chesley
3,785,301 A 1/1974 Lundqvist
3,797,903 A * 3/1974 Traulsen ..... A47B 57/08 108/110
3,915,097 A 10/1975 Young, Jr.
3,981,250 A * 9/1976 Anthony ..... A47B 57/26 108/106
3,986,616 A * 10/1976 Gray ..... A47B 96/021 108/107
4,067,530 A 1/1978 Overman
4,233,912 A * 11/1980 Ferdinand ..... A47B 57/10 108/109
4,345,525 A 8/1982 De Poorter
4,405,052 A * 9/1983 Spiros ..... A47B 57/50 211/187
4,421,239 A * 12/1983 Vargo ..... A47B 57/404 108/107
4,444,323 A * 4/1984 Travis ..... A47B 57/52 108/108
4,457,239 A 7/1984 Heinze
4,469,031 A 9/1984 Haycock
4,501,369 A * 2/1985 Fox ..... A47B 57/26 108/147.12
4,582,001 A * 4/1986 Leikarts ..... A47B 57/265 108/106
4,593,826 A * 6/1986 Bustos ..... A47B 57/265 108/147.12
4,706,576 A 11/1987 James
4,711,420 A * 12/1987 Cowler ..... A47B 57/42 248/224.8
4,735,325 A * 4/1988 Remmers ..... A47B 96/068 211/107
4,742,782 A 5/1988 Miller
4,815,394 A * 3/1989 Ettlinger ..... A47B 57/265 108/107
4,852,501 A * 8/1989 Olson ..... A47B 57/265 108/107
5,205,630 A * 4/1993 Welch ..... A47B 47/021 108/107
5,271,337 A * 12/1993 Kolvites ..... A47B 47/04 108/107
5,350,073 A * 9/1994 Thornley ..... A47B 57/22 108/107
5,372,415 A * 12/1994 Tisbo ..... A47B 47/042 108/109
5,797,502 A * 8/1998 Brady ..... A47F 1/12 108/107
5,797,503 A * 8/1998 Stevens ..... A47B 31/00 108/107
5,957,060 A 9/1999 Rosenband
6,053,115 A * 4/2000 Felton ..... A47B 46/005 108/107
6,062,401 A * 5/2000 Hall ..... A47B 87/0246 108/144.11
6,302,284 B1 * 10/2001 Zonshin ..... A47B 47/0083 108/147.11
6,311,856 B2 * 11/2001 Battaglia ..... 108/107
6,526,897 B1 3/2003 Ondrasik
6,796,248 B1 * 9/2004 Dressendorfer ..... A47B 57/10 108/106
6,814,362 B2 11/2004 Hanson et al.
7,113,762 B1 * 9/2006 Hertz ..... H05K 7/1488 361/600
7,478,971 B2 * 1/2009 Li ..... A47B 57/545 108/147.13
7,533,948 B2 * 5/2009 Smith ..... A47B 55/02 108/107
7,669,945 B2 3/2010 Blersch et al.
7,886,673 B2 * 2/2011 Korte ..... A01G 9/143 108/110
D688,905 S * 9/2013 Stravitz ..... D6/705
8,616,388 B2 * 12/2013 Butler ..... A47B 43/00 108/106
8,875,910 B2 * 11/2014 Wurr ..... A47B 57/50 211/187
2002/0043187 A1 * 4/2002 Felton ..... A47B 46/005 108/107
2003/0029362 A1 * 2/2003 Ondrasik ..... A47F 5/01 108/110
2004/0000260 A1 * 1/2004 Connor ..... A47B 9/02 108/147.15
2004/0222178 A1 * 11/2004 Sparkowski ..... A47B 55/02 211/187

(56) References Cited

U.S. PATENT DOCUMENTS

| | | | | |
|---|---|---|---|---|
| 2005/0217543 | A1* | 10/2005 | Hung | A47B 47/024 108/186 |
| 2008/0121600 | A1* | 5/2008 | Korte | A47B 31/00 211/187 |
| 2010/0252520 | A1* | 10/2010 | Hsu | F16B 12/24 211/186 |
| 2011/0253656 | A1 | 10/2011 | Vermeer | |
| 2016/0022034 | A1* | 1/2016 | Hu | A47B 47/00 211/186 |
| 2016/0143438 | A1* | 5/2016 | Jablow | A47B 96/024 211/186 |
| 2016/0166059 | A1* | 6/2016 | Zohar | A47B 81/02 312/257.1 |

FOREIGN PATENT DOCUMENTS

| | | | |
|---|---|---|---|
| CN | 101715312 | A | 5/2010 |
| CN | 202425968 | U | 9/2012 |
| CN | 202445531 | U | 9/2012 |
| CN | 202567034 | U | 12/2012 |
| DE | 2737862 | A1 | 3/1979 |
| DE | 3308314 | A1 | 8/1983 |
| DE | 29922524 | U1 | 5/2001 |
| DE | 20200500920 | U1 | 9/2005 |
| DK | 139747 | B | 4/1979 |
| EP | 0121745 | B1 | 7/1987 |
| FR | 2087092 | A6 | 12/1971 |
| GB | 1569405 | A | 6/1980 |
| JP | H10165233 | A | 6/1998 |
| WO | 9510208 | A1 | 4/1995 |
| WO | 2004089159 | A1 | 10/2004 |
| WO | 2005053459 | A1 | 6/2005 |

OTHER PUBLICATIONS

International Search Report issued in related application No. PCT/DK2014/050248, Dec. 15, 2014.

Written Opinion of the International Searching Authority issued in related application No. PCT/DK2014/050248, Dec. 15, 2014.

Danish Search Report issued in priority application No. PA 2013 70455, Apr. 4, 2014.

International Search Report issued in corresponding application No. PCT/DK2014/050246, Dec. 8, 2014.

International Preliminary Report on Patentability issued in corresponding application No. PCT/DK2014/050246, together with amended sheets of claims, Jul. 23, 2015.

Written Opinion of the International Searching Authority issued in corresponding application No. PCT/DK2014/050246, Dec. 8, 2014.

USPTO Non-Final Office Action issued in related U.S. Appl. No. 14/912,492, Jan. 12, 2017.

SIPO Search Report issued in related Chinese patent application No. 2014800463124, Nov. 12, 2016.

SIPO Office Action issued in related Chinese patent application No. 2014800463124, Nov. 21, 2016 (with English translation).

SIPO Examination Report issued in corresponding Chinese patent application No. 201480046303.5, Feb. 4, 2017.

* cited by examiner

SYSTEM FOR THE MOUNTING OF SHELVES

CROSS-REFERENCE TO RELATED APPLICATIONS

This application is the U.S. National Stage Application of International Application No. PCT/DK2014/050246, filed on 20 Aug. 2014, and published on 26 Feb. 2015 as WO 2015/024571 A1, which claims the benefit of priority to Danish Patent Application Serial No. PA 2013/70455, filed on 21 Aug. 2013, the disclosure and teachings of which are incorporated herein by reference.

BACKGROUND

The present invention relates to a system for the mounting of shelves on a substantially rectangular load carrier having four identical columns arranged in the corners thereof, said system comprising columns having a rectangular profile with four side faces, a substantially rectangular shelf of a length which is shorter than the distance between the columns of the load carrier, on which shelf at least one holder is mounted that can be inserted into complementary slots in the columns of the load carrier, said slots being configured with support faces with which the holder is capable of engaging in such a manner that the holder supports on the column.

Load carriers, such as carriages for handling goods, plants, products, etc., are widely used in the retail business, and often they are provided with a set of front wheels and a set of rear wheels mounted on the underside of a bottom frame having vertical columns that extend upwards from the corners of the bottom frame. One or more shelves are arranged for supporting the load charged to the carriage. Usually, the shelves are connected to each of the vertical columns by means of hooks arranged at the corners of the shelves. The hooks are configured to engage with slots arranged at suitable intervals in the longitudinal direction of the columns, and the shelves can hereby be mounted or dismounted, moved and/or removed depending on the use situation. That the shelves are removable also means that load carriers take up less space during return transport in empty state.

Within the field of working environment, there is an ongoing development towards automated processes whereby the shelves are mounted in the columns by means of robots. It is a drawback of the known systems, as described eg in Danish patent No. 139 747, that the shelves are, during mounting, first to be mounted in the one column and then in the other. The reason for this is that the distance between the vertical side faces of the columns is shorter than the total length between the holders of the shelf.

In practice the known construction thus entails that the shelf is to be introduced between the columns at an angle to the vertical, following which the holders of the shelf are introduced into the slots of the column, first at the one side and then at the other side, before the shelf is capable of carrying loads.

Within the field of handling equipment, ever increasingly strict demands are made to the automation of processes, efforts being made to replace uniform work and lifting by machinery.

By the known systems, the automated process is to take place by the machine first inserting the shelf in an inclined position between two columns, following which the holders on the one shorter side of the shelf are inserted into the slots on two columns, following which the angle of the shelf is changed to horizontal, while at the same time the holders at the other short side of the shelf are inserted into the slots of two other columns.

This process, which requires that a robot performs both rotating and linear movements, is technically complicated and hence costly to automate.

OBJECT AND BRIEF DESCRIPTION OF THE INVENTION

It is an object of the invention to provide a system for the mounting of shelves, by which mounting and dismounting, respectively, of shelves on the columns of the system can be carried out without the individual shelves having to be rotated.

It is a further object that the shelf can be inserted and removed even in case of very close shelf arrangement, ie in case of a very short distance between the individual shelves.

The exposure as such of products, such as eg flowers, may also take place by a small inclination of the shelf.

This is accomplished by a system as set forth above which is characterised in that the columns are configured with slots that extend symmetrically about a longitudinally extending centre axis of one of the side faces and through the side faces adjacent to that side face, each of said slots being configured with three substantially identical cut-outs, the one of which is situated in the axis of symmetry and the two remaining ones are in the adjacent side faces, said cut-outs being capable of functioning as support faces for the holders of the shelf, them being arranged on the shorter sides of the shelf and extending in the longitudinal direction of the shelf to the effect that they are capable of engaging with the slots in the four columns arranged on the load carrier.

According to one embodiment, the system is characterised in that the holders each separately span out a rectangle between it and the shelf.

By that embodiment it is accomplished that the holders of the shelf become more robust and are not so easily deformed if the shelf is eg lost or in other ways exposed to impacts or blows.

According to a further embodiment, the columns are each separately configured with at least four slots to the effect that the load carrier can be fitted with four shelves, and wherein the slots are each separately configured with a fourth cut-out extending in a direction opposite the cut-out located in the axis of symmetry, said fourth cut-outs being configured with different appearances.

By configuring the fourth cut-out with a different appearance, it is accomplished to provide easier manual mounting, since the operator is thereby enabled to identify the individual slots and is consequently also capable of mounting the holders of the shelf in the slots positioned at the same height.

BRIEF DESCRIPTION OF THE DRAWING

In the following, embodiments of the invention are described with reference to the accompanying figures. It is to be stressed that the embodiments shown are exemplary, and that the invention is not limited thereto, wherein.

DETAILED DESCRIPTION

Figure 1:
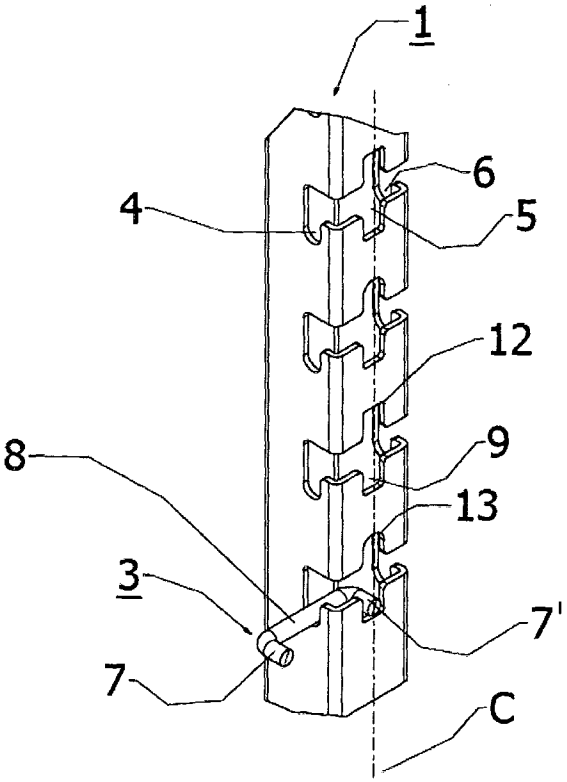
FIG. 1 is a perspective view of a section of a column with holder inserted therein.
Figure 2:
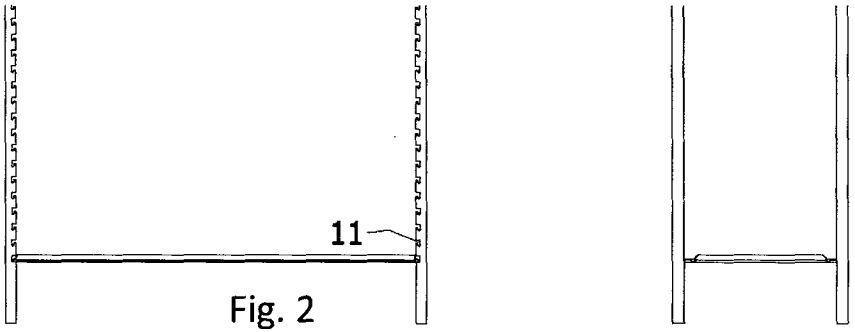
FIG. 2 shows columns with a shelf inserted, seen from in front.

With starting point in the shown figures, in particular FIG. 1, a column 1 is shown into which a holder 3 is inserted. In the shown embodiment, the column is constructed symmetrically about a longitudinally extending axis of symmetry C.

The holder 3 as such is configured as a bend comprising two parallel legs 7,7' that extend substantially at right angles from a middle part 8. As will appear most clearly from FIG. 3, the two legs of the holder are arranged in a rectangular shelf 20 on the shorter side thereof. As will also appear from FIG. 3, the shelf is usually provided with four identical holders 3 that are arranged, two-by-two, on the shorter sides of the shelf. Of course, the shelf may also be configured to be square, in which case the holders are arranged at opposing sides. According to a preferred embodiment, the shelf is configured such that it is symmetrical about a longitudinally extending axis of symmetry $C_L$. And according to yet an embodiment, the shelf is also configured to be symmetrical about a transverse axis of symmetry (not shown in the figures).

The two parallel legs 7 and 7' of the holder are arranged inside the shelf in such a way that the middlemost part 8 is arranged at a distance from the shelf. Thereby an opening 10 is formed between holder and shelf. This opening is the one serving as "hook" when the shelf is to be attached to a column.

In FIG. 1, in the exemplary embodiments shown, the holder 3 is configured such that the opening 10 which is spanned out between it and the shelf constitutes a rectangle, but, of course, the holder can also be configured such that this opening constitutes another shape. This means that the middle part can be configured to be rounding, and, likewise, the two legs 7 and 7' need not necessarily be in parallel. However, it is advantageous if they are.

The right one 7' of the parallel legs of the holder extends, in the embodiment shown in FIG. 1, out through a cut-out situated in the axis of symmetry C of the column, and that cut-out 5 extends in a downward direction.

FIG. 1 shows a section of a column. The column as such is, as explained above, constructed symmetrically about a longitudinally extending axis of symmetry C. The column is configured with a number of slots that each separately serves to retain a shelf.

These slots, each of which extends through three of the sides of the column, are usually distributed evenly in the longitudinal direction of the column. The slots are all configured with three substantially identical, downwardly extending cut-outs 4, 5, 6, of which the first one 5 is situated in the axis of symmetry of the column, while the two others 4, 6 are situated approximately at the middle of the two sides that sit at right angles to the side having the first cut-out.

By configuring the slots in this way, the holders on a shelf configured in accordance with the invention and as shown in the figures may be shifted horizontally through a slot in a shelf. This is used to advantage in the invention, the length as such of the shelf being shorter than the distance between two columns, while, at the same time, the total length of shelf plus holder is adapted to the distance between the same two columns in such a way that the shelf can be pushed in between them, the holders passing through slots in the column and in such a manner that the legs 7, 7' and the middle part 8 on the holder are, when the shelf is being lowered, capable of engaging with the downwardly extending cut-outs in the column as shown in FIG. 1.

Figure 3:
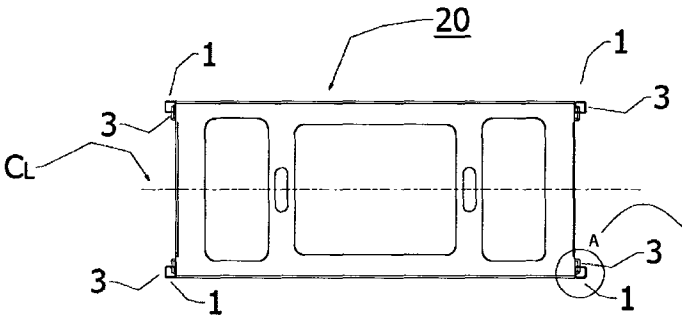
FIG. 3 shows a shelf with holders, seen from above.
Figure 4:
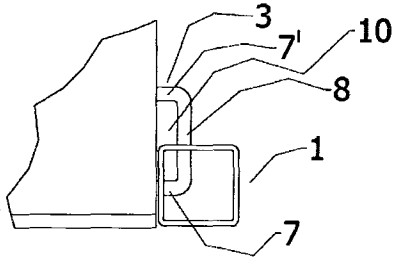
FIG. 4 shows section A from FIG. 3, in enlarged view.
Figure 5:
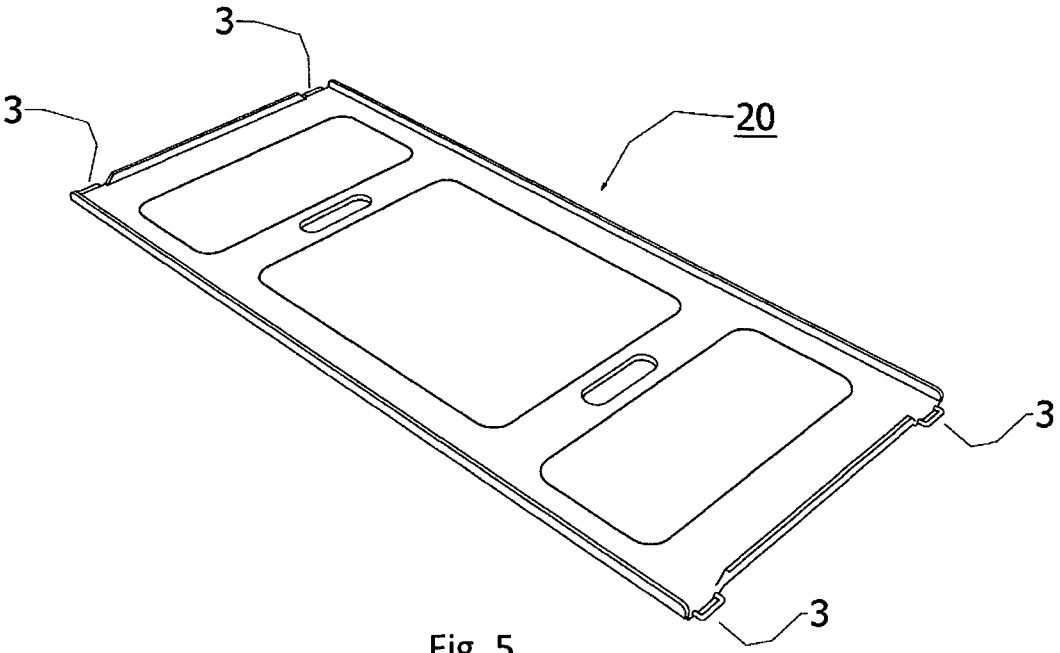
FIG. 5 is a perspective view of a shelf.

According to an embodiment, as shown in FIGS. 3, 4, and 5, the shelf is configured symmetrically about a longitudinally extending axis of symmetry (not shown in FIGS. 4 and 5), while, at the same time, the holders are arranged such on the shelf that it is the outermost parts of the holders that have a hold in the slots/cut-outs of the columns (ie the part of the holder which is farthest away from the longitudinally extending axis of symmetry).

When a fitter is to mount several shelves on columns where the distances between the individual slots are short, he/she may easily accidentally mount the shelf with the one side at one level, while the other side is mounted at another level.

To prevent this, the invention is, in one embodiment, configured with columns where each individual slot is configured with a fourth cut-out. That cut-out is situated in the axis of symmetry and extends upwards as opposed to the downwardly facing cut-out 5 of the axis of symmetry.

Figure 6:
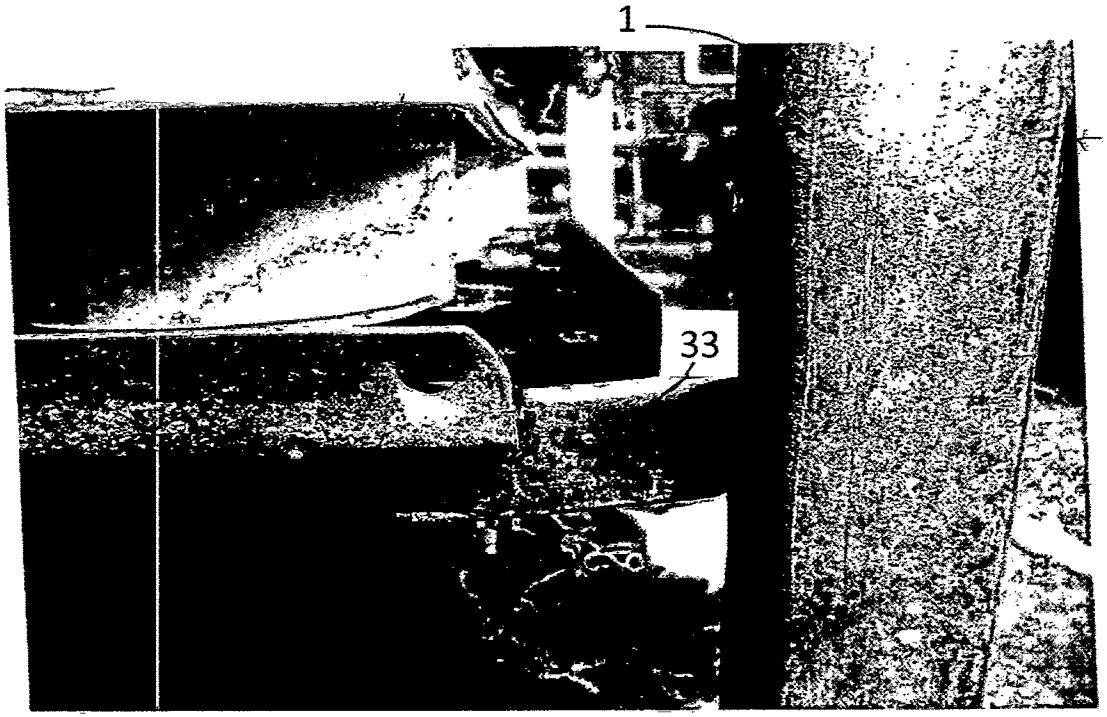
FIG. 6 depicts a shelf on which a conventional hook is mounted.

Those fourth cut-outs are configured with two different appearances 12, 13 that are applied alternatingly seen in the longitudinal direction of the column. As will appear from FIG. 1, the two appearances may eg be a rounded shape 13 as shown at the bottom of the column and an angular shape 12 as shown at the top of FIG. 1. The purpose of allowing the appearance of the upwardly facing cut-out alternate is thus to visualise the individual levels to the effect that the operator is capable of more easily intentionally mounting the shelves horizontally or askew for that matter. It is a further object of the upwardly facing cut-out to also create space for a conventional hook in order to thereby enable that existing shelves configured with a hook, as shown in FIG. 6, can be mounted in a column according to the invention. As it is, those hooks 33 are usually configured such that, relatively speaking, they have a considerably larger expanse in the vertical than they have in the horizontal (when the shelf is mounted in the columns), and it is that vertical expanse of the conventional hook that can be received in the upwardly facing cut-out 12, 13.

The two different appearances of the upwardly facing cut-outs are not a prerequisite for the invention to function in combination with known hook systems that require only an upwardly facing cut-out. However, it is an advantage if the system both has upwardly facing cut-outs and that they are configured with two different appearances.

What is claimed is:

1. A system for the mounting of shelves on a substantially rectangular load carrier having four identical columns arranged at corners thereof, said system comprising:

the four columns each having a rectangular profile with four side faces, a substantially rectangular shelf of a length which is shorter than a distance between corresponding columns of the load carrier, at least one holder mounted on said shelf, the at least one holder comprising two parallel legs and a middle part extending between the legs thereby creating an opening between the least one holder and the shelf, wherein slots are formed in each column and each slot extends symmetrically about a longitudinally extending centre axis of a first side face of the side faces and through the side faces adjacent to the first side face resulting in each of said slots continuously extending through three adjacent sides and having three downwardly-extending cut-outs, at least one of said cut-outs which is situated on the first side face and in an axis of symmetry of the column and the two remaining cut-outs are formed in the corresponding adjacent side faces, respectively, such that said cut-outs are configured to support each holder of the shelf, and the columns each define a protruding portion between an adjacent pair of downwardly extending cut outs, wherein one of said corresponding openings defined by a corresponding holder is configured to receive a respective protruding portion therein, wherein the at least one holder comprises at least two holders each extending outwardly in a longitudinal direction from two opposing ends of the shelf on shorter sides of the shelf and are configured to engage with corresponding slots of respective columns when the parallel legs and middle part of the holder are passed through the slots and engage two or more of the three downwardly-extending cut-outs of each slot arranged on the load carrier for simultaneous mounting of the shelf thereon and removal of the shelf therefrom without rotation of the shelf.

2. A system according to claim 1, wherein each opening has a rectangular shape.

3. A system according to claim 1, wherein the columns each have at least four slots to the effect that four shelves can be mounted on the load carrier.

4. A system according to claim 1, wherein the slots each have a fourth cut-out extending in a direction opposite one of the three downwardly extending cut-outs.

5. A system according to claim 1, wherein the slots each have a fourth cut-out extending in a direction opposite one of the three downwardly extending cut-outs, and wherein the fourth cut-outs on each said column comprises at least two different configuration shapes that alternate along the longitudinal direction of the respective columns.

6. A system according to claim 2, wherein the columns each have at least four slots to the effect that four shelves can be mounted on the load carrier.

7. A system according to claim 2, wherein the slots each have a fourth cut-out extending in a direction opposite one of the three downwardly extending cut-outs.

8. A system according to claim 3, wherein the slots each have a fourth cut-out extending in a direction opposite one of the three downwardly extending cut-outs.

9. A system according to claim 2, wherein the slots each have a fourth cut-out extending in a direction opposite one of the three downwardly extending cut-outs, and wherein the fourth cut-outs on each said column comprises at least two different configuration shapes that alternate along the longitudinal direction of the respective columns.

10. A system according to claim 3, wherein the slots each have a fourth cut-out extending in a direction opposite one of the three downwardly extending cut-outs, and wherein the fourth cut-outs on each said column comprises at least two different configuration shapes that alternate along the longitudinal direction of the respective columns.

11. A system according to claim 4, wherein the slots each have a fourth cut-out extending in a direction opposite one of the three downwardly extending cut-outs, and wherein the fourth cut-outs on each said column comprises at least two different configuration shapes that alternate along the longitudinal direction of the respective columns.

* * * * *